US007482523B1

(12) United States Patent
Hamilton

(10) Patent No.: US 7,482,523 B1
(45) Date of Patent: Jan. 27, 2009

(54) LAYERED COMPOSITE PICK GUARD FOR STRINGED MUSICAL INSTRUMENTS

(76) Inventor: Troy M. Hamilton, 552 Miramonte Dr., Santa Barbara, CA (US) 93109

( * ) Notice: Subject to any disclaimer, the term of this patent is extended or adjusted under 35 U.S.C. 154(b) by 0 days.

(21) Appl. No.: 11/900,965

(22) Filed: Sep. 15, 2007

Related U.S. Application Data

(60) Provisional application No. 60/825,765, filed on Sep. 15, 2006.

(51) Int. Cl.
*G10D 9/00* (2006.01)

(52) U.S. Cl. ..... 84/453

(58) Field of Classification Search ..... 84/327, 84/329

See application file for complete search history.

(56) References Cited

U.S. PATENT DOCUMENTS 4,602,547 A 7/1986 Nyack, Jr. et al.
5,517,891 A * 5/1996 Sica ..... 84/453
2005/0211052 A1 9/2005 Gigliotti
2005/0241456 A1 11/2005 Nakamura et al.

* cited by examiner

*Primary Examiner*—Kimberly R Lockett
(74) *Attorney, Agent, or Firm*—J. E. McTaggart

(57) ABSTRACT

A laminated structure for pick guards and back plates for guitars or other stringed instruments, electric or acoustic, utilizes a layered composite material typically featuring two metal facers bonded together with a composite plastic non-conductive core material, and typically coating the exterior surfaces with a durable anti-scratch layer. The pick guard is machined to shape, edge-beveled, edge-polished and drilled custom to each make and model. The non-conductive core between metal layers forms an electrical capacitor. The composite laminated stack serves as an electrostatic shield to reduce pickup interference, and is much lighter in weight than an equivalent all-metal panel. Providing scratch protection, control mounting, shielding and aesthetic benefits, the pick guard can be retrofitted to instruments after-market or incorporated in original manufacture.

9 Claims, 2 Drawing Sheets

LAYERED COMPOSITE PICK GUARD FOR STRINGED MUSICAL INSTRUMENTS

PRIORITY

Benefit is claimed under 35 USC 119(e) of pending U.S. provisional application 60/825,765 filed Sep. 15, 2006.

FIELD OF THE INVENTION

The present invention is in the field of musical instruments more particularly a pick guard structure for use with guitars and other stringed musical instruments.

BACKGROUND OF THE INVENTION

It is well known to provide a pick guard of some sort attached to the surface in the picking/strumming region of guitars and other stringed instruments to protect the material and finish of the instrument in that region from abrasion and other potential damage from picks and from the players' hands, fingernails, rings, etc. However the pick guard itself becomes vulnerable to frequent playing or abuse, and the usual metal or plastic surfaces often become scratched and unsightly.

DISCUSSION OF PRIOR ART

U.S. Pat. No. 5,517,891 to Sica for a GUITAR PICK GUARD typifies attempts to make the pick guard surface resistant to scratching and general surface deterioration, while protecting the guitar finish, claiming novelty for a top layer of fabric, for a bottom layer of felt and for a middle layer of flexible plastic.

In addition to its original function as basically an instrument protector, the pick guard has evolved into a major aesthetic feature utilizing colors and finishes selected to express a fashion message, and is often called upon to take on other roles such as favorably modifying the sound and/or providing a mounting base for user controls of electric guitars.

Publication US 2005/0211052 A1 for GUITAR HAVING A METAL PLATE INSERT by Gigliotti discloses a full size metal plate that could be considered a pick guard, flexibly attached to the guitar body and said to produce a unique resonant tone. Finished with a brush or swirl pattern, it produces a constantly changing look as the finished metal catches and reflects light.

U.S. Pat. No. 4,602,547 to Nyack & Nyack shows a typical pick guard extending over a major portion of a guitar body top surface, claiming novelty for pickup cores protruding through an opening in the pick guard.

Publication US 2005/0241456 A1 to Nakamura for MULTILAYER PICKGUARD DEVICES AND METHODS THEREFOR addresses pick guards of thermo-set and plastic materials configured in multi-layers that attach in a clip-on manner along the edge of the sound hole in an acoustic guitar and that are readily replaceable in a non-destructive manner for purposes of changing the appearance.

OBJECTS OF THE INVENTION

It is a primary object of the invention to provide a pick guard for guitars and other stringed instruments that in addition to visual aesthetic excellence, protects the instrument finish while providing a playing surface with extreme wear and moisture resistance.

It is a further object that the pick guard provide enhanced RFI shielding to reduce extraneous noise entering the pickup cavity.

It is a further object to provide lower acoustic sound absorption than plastic pick guards for enhanced sound.

It is a further object to provide an attachment system that is superior to peel-and-stick foil coverings regarding shielding, durability and appearance.

SUMMARY OF THE INVENTION

The above objects have be realized in the present invention of laminated structure for pick guards and back plates for guitars or other stringed instruments, electric or acoustic. In a typical panel of layered composite material, two layers of metal, preferably aluminum, are bonded together with a composite polyethylene, polystyrene or other non-conductive core material, and typically includes surface finishes, e.g. an anti-scratch exterior coating.

The pick guard is machined to shape, beveled, edge-polished and drilled custom to each make and model. The non-conductive core between metal layers forms an electrical capacitor. The composite stack serves as an electro-static and radio frequency shield to reduce pickup interference as much as 40%, and is much lighter in weight than an equivalent all-metal panel. Providing scratch protection, control mountings, shielding and aesthetic benefits including custom finishes and colors, the pick guard can be retrofitted to instruments after-market or incorporated in original manufacture.

DETAILED DESCRIPTION

Figure 1:
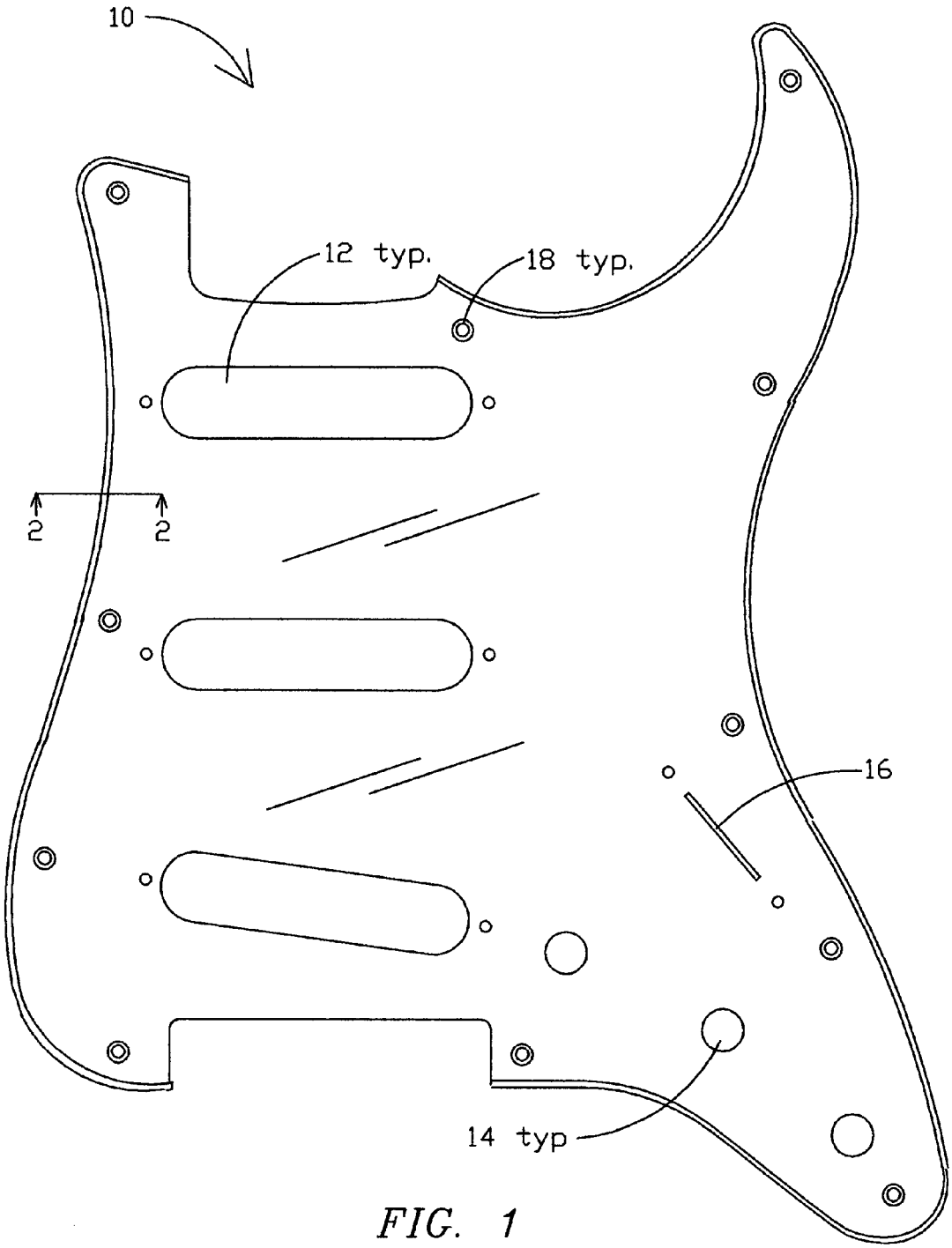
FIG. 1 is a plan view showing a pick guard representing an illustrative embodiment of the present invention.

FIG. 1 is a plan view of a pick guard 10 representing an illustrative embodiment of the present invention. The example shown, approximately 8½ by 11 inches in size, covers a major portion of the face side of an electric guitar body.

The three larger openings 12 and associated mounting screw holes are sized to fit closely around the electric guitar pickups, which typically extend through to approximately ⅛" above the surface. The three ⅜ diameter holes 14 are for mounting standard potentiometer type user controls, and the hole pattern 16 is for a typical lever type user switch for pickup selection. The eleven holes 18 spaced around the edge are countersunk to accept oval- or flat-headed mounting screws.

Figure 2:
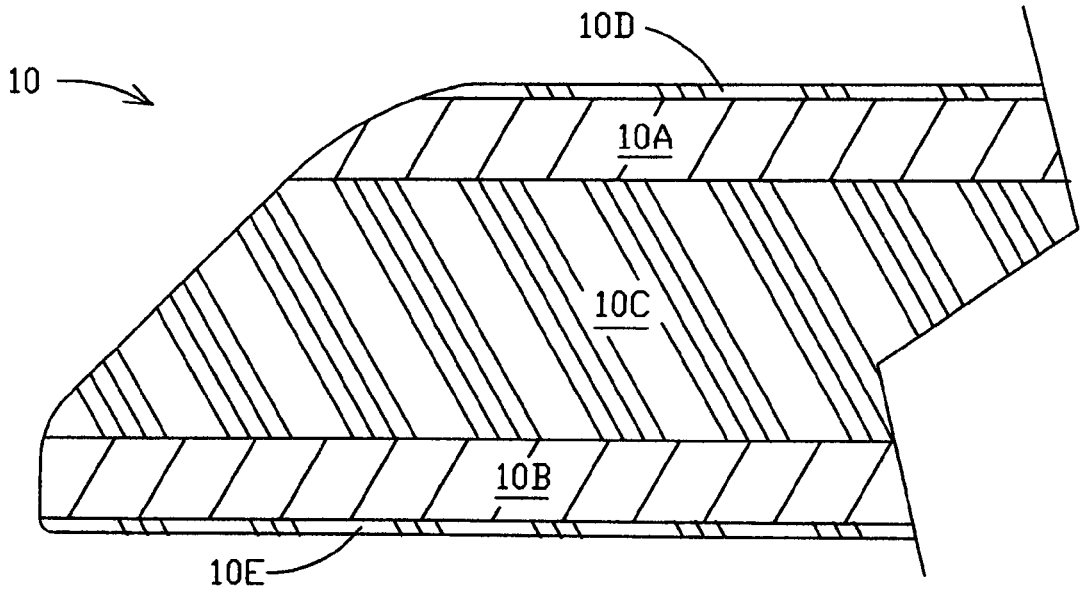
FIG. 2 is a cross-section of the pick guard of FIG. 1 taken at axis 2-2, showing laminations at a typical edge region of the pick guard.

FIG. 2 is a cross-section of the pick guard 10 of FIG. 1 taken at axis 2-2, showing the laminated structure at a typical edge region of the pick guard 10, typically made about 0.12 inch in total thickness. The main top layer 10A and the main bottom layer 10B both of aluminum sheet material, typically 0.012 inch thick, are bonded onto the two opposite sides of the non-conductive core layer 10C, typically of plastic such as polyethylene or polystyrene. For added protection, the exposed surface of the top layer 10A is coated with a tough anti-scratch material which may be a clear coat or decoratively colored in a custom finish. Similarly the bottom surface of layer 10B may be covered with a tough typically non-conductive coating 10E for protection of the guitar finish since layer 10B normally interfaces the guitar when the pick guard 10 is attached by screws through the countersunk holes 18 (FIG. 1).

Fabrication of the pick guard from a blank laminated workpiece is best performed by automated machines under computerized numeric control (CNC) in a process involving five main steps:

1. The outline is cut from a laminated blank workpiece to from the required shape perpendicular edges.

2. The edges of the top layer 10A and the core layer 10C are initially chamfered, preferably leaving the edge of bottom layer 12B perpendicular.

3. The edges are polished to a fine finish with sharp corners rounded off.

4. All holes are drilled.

5. Screw holes are countersunk.

The two metal plates separated by the non-conductive core layer form an electrical capacitor. A typical full-sized pick guard such as the illustrative embodiment shown in FIG. 1 provides about 400 pF (picofarads) capacitance, i.e. an impedance of approximately 400 ohms capacitive reactance at a frequency of 1 MHz, decreasing in impedance at higher frequencies in inverse proportional relationship.

Regarding electrical connection to the two metal layers 10A and 10B, they may be connected together and/or grounded, i.e. one or both connected, directly or indirectly, to the metal case or common ground bus of an electronic module or the outer shield of a shielded cable. There are five modes of layer connection in which the pick guard of the invention can be deployed and practiced beneficially:

(1) Exposed layer 10A grounded, bottom layer 10 unconnected, i.e. "floating".

(2) Bottom layer 10B grounded, exposed layer 10A unconnected.

(3) Both metal layers grounded.

(4) Both layers unconnected.

(5) The two layers connected together. but not grounded.

Mode (1) above is considered preferable. In modes (3) and (5), connecting the plates together causes a short circuit that defeats the capacitive effect. However there is beneficial electrostatic shielding effect in any of the five modes. The amount of benefit varies with the inherent shielding built into different electric guitars: typically the addition of a laminated pick guard of the present invention RF has been found to reduce noise interference by about 40%.

Whichever of the abovementioned modes is deployed, design efforts should be made to ensure the desired conductive conditions for the selected mode. The assembly structure for mounting the controls should be designed to positively contact or insulate as required to prevent "mode-hopping", since unpredictable random contact, e.g. at the control mounting holes 14 or the lever switch slot 16 could cause interference or inconsistency. The finish on the panels is normally non-conductive and may need to be removed in a particular area where contact is desired e.g. at the control mountings. At some locations protection against unintended "shorts" may be required to avoid unwanted contact.

The laminated structure of the invention can be practiced with variations in plate and core material and thickness and in pick guards and mounting plates of various shapes and sizes for both electric and acoustic stringed instruments. Further information is available at internet website http://www.axeguardz.com.

The laminated structure of the invention can be utilized for purposes other than as a pick guard, e.g. as a mounting plate for simply mounting one or more user controls anywhere on a musical instrument or onto other non-musical devices such as test instruments. The laminated structure of the invention can be utilized to form the top plate of a guitar-type pickup and may be formed with openings for individual poles.

The invention may be embodied and practiced in other specific forms without departing from the spirit and essential characteristics thereof. The present embodiments are therefore to be considered in all respects as illustrative and not restrictive, the scope of the invention being indicated by the appended claims rather than by the foregoing description; and all variations, substitutions and changes which come within the meaning and range of equivalency of the claims are therefore intended to be embraced therein.

What is claimed is:

1. A pick guard, for attachment to a host stringed musical instrument, comprising:

a first layer of sheet metal having a first side surface, and having a second and opposite side surface;

an intermediate layer of non-conductive material having a first side surface bonded to the second side surface of said first layer, and having a second and opposite side surface; and a second layer of sheet metal having a first side surface bonded to the second side surface of said intermediate layer, and having a second and opposite side surface.

2. The pick guard as defined in claim 1 further comprising a finish layer of durable material applied to the first side surface of said first layer.

3. The pick guard as defined in claim 2 further comprising a finish layer of durable material applied to the second side surface of said second layer.

4. The pick guard as defined in claim 2 installed on a main body portion of a stringed musical instrument with said first side of said first layer interfacing the instrument body and the second side of said second layer facing outwardly toward strings of the host stringed musical instrument.

5. The pick guard as defined in claim 4 wherein boundary edges of said pick guard are configured s such that the edges of at least said intermediate layer and said second layer over a major peripheral portion of said pick guard are chamfered in a cross-sectional shape that is inclined so as to form an obtuse angle between the chamfered edges and said second layer.

6. The pick guard as defined in claim 5 further configured with mounting openings to mount a set of user controls associated with the host stringed musical instrument.

7. The pick guard as defined in claim 6 further made and arranged to serve as an electrostatic shield to reduce adverse effects of electrical interference on performance of the host stringed musical instrument.

8. A method of fabricating and deploying a laminated guard plate for mounting user controls, protecting an instrument against scratches from fingernails and other objects and providing electrical shielding, comprising the steps of:

(1) forming a laminated sheet having an intermediate layer of non-conductive material bonded between two sheets of metal;

(2) cutting the laminated sheet to a desired outline shape of a guard plate in preliminary form with perpendicular peripheral edges;

(3) chamfering a major portion of the peripheral edges to a designated non-perpendicular cross-sectional inclined shape;

(4) smoothing the chamfered peripheral edges;

(5) configuring the workpiece with a predetermined set of through-openings;

(6) further machining designated ones of the through-openings to have a countersink shape; and (7) attaching the guard plate in place onto a designated region of the instrument.

9. The method of fabricating and deploying a laminated guard plate as defined in claim 8 further comprising, in step (1), an additional subsequent sub-step (1A) of applying a durable non-conductive anti-scratch coating to at least one side of the laminated sheet.

* * * * *